US007147532B2

(12) United States Patent
Perez et al.

(10) Patent No.: US 7,147,532 B2
(45) Date of Patent: Dec. 12, 2006

(54) LAMP ASSEMBLY AND METHOD OF FORMING

(75) Inventors: Jimmy Perez, Corvallis, OR (US); John Lee, Sweet Home, OR (US); Andrew Lovvorn, Albany, OR (US); Bob Sattem, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 355 days.

(21) Appl. No.: 10/769,394

(22) Filed: Jan. 30, 2004

(65) Prior Publication Data

US 2005/0168118 A1 Aug. 4, 2005

(51) Int. Cl.
*H01J 9/26* (2006.01)

(52) U.S. Cl. ..... 445/44

(58) Field of Classification Search ..... 313/318.01, 313/318.03; 445/43, 44, 26
See application file for complete search history.

(56) References Cited

U.S. PATENT DOCUMENTS 5,216,318 A 6/1993 Van Dulmen et al.
5,463,270 A * 10/1995 Wakimizu et al. ..... 313/318.01
6,614,187 B1 9/2003 Kanzaki et al.

* cited by examiner

*Primary Examiner*—Joseph Williams

(57) ABSTRACT

A replaceable lamp header for positioning a lamp within a reflector assembly, includes a base member, a lamp engaging member extending from a first surface of the base member in which the lamp engaging member includes a proximal end and a distal end, a lamp receiving cavity defined in the lamp engaging member, and at least one fill hole defined in a proximal end of the lamp engaging member and extending through the lamp engaging member into the lamp receiving cavity.

15 Claims, 9 Drawing Sheets

LAMP ASSEMBLY AND METHOD OF FORMING

BACKGROUND

Digital projectors, such as digital mirror devices (DMD) and liquid crystal display (LCD) projectors, project high quality images onto a viewing surface. Both DMD and LCD projectors utilize high intensity lamps and reflectors to generate the light needed for projection. Light generated by the lamp is concentrated as a 'fireball' that is located at a focal point of a reflector. This light is directed into a projection assembly that produces images and utilizes the generated light to form the image. The image is then projected onto a viewing surface. Misalignment of the focal point causes degradation of the image since less light is captured, and creates 'hot spots' on the screen instead of a uniform brightness.

Efforts have been directed at making projectors more compact while making the image of higher and higher quality. As a result, the lamps utilized have become more compact and of higher intensity. Higher intensity lamps produce high, even extreme heat. The outer surface of the lamps can approach temperatures of 900° C. As a result, projector designs must account for the intense heat. In addition, losses due to misalignment of the fireball with respect to the reflector are amplified in systems utilizing high intensity lamps.

Some designs attempt to mitigate adverse effects of the heat by permanently placing the lamp within the reflector. A high temperature adhesive holds the lamp relative to the reflector. For example, the lamp may be secured to a lamp header with the high temperature adhesive in order to maintain the aligned relationship between the reflector and the lamp. The adhesive may be applied by hand with a brush. The adhesive thus applied may not be applied evenly throughout the gap because the adhesive resists downward flow as it sticks to the lamp and the header. As a result, the applied adhesive may be uneven and/or contain voids therein. In addition, there is limited access to the gap between the lamp and the lamp header due at least in part to the presence of the lamp. This limited access makes automation difficult. Similarly, applying adhesive with a brush is a time consuming process, which adds expense to the manufacturing process.

SUMMARY

A replaceable lamp header for positioning a lamp within a reflector assembly includes a base member, a lamp engaging member extending from a first surface of the base member in which the lamp engaging member includes a proximal end and a distal end, a lamp receiving cavity defined in the lamp engaging member, and at least one fill hole defined in a proximal end of the lamp engaging member and extending through the lamp engaging member into the lamp receiving cavity.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings similar elements in different embodiments are designated with similar prefixes and different suffixes. Identical reference numbers designate similar, but not necessarily identical, elements.

DETAILED DESCRIPTION

A replaceable lamp header for positioning a lamp within a reflector assembly includes a base member, a lamp engaging member extending from a first surface of the base member in which the lamp engaging member includes a proximal end and a distal end, a lamp receiving cavity defined in the lamp engaging member, and at least one fill hole defined in a proximal end of the lamp engaging member and extending through the lamp engaging member into the lamp receiving cavity.

A lamp is aligned with respect to the lamp header, and then is secured in the aligned relationship by applying an adhesive through the fill hole and allowing the adhesive to cure. By applying the adhesive through the fill hole, the adhesive may be applied in a more controlled and rapid fashion. Further, the location of the fill holes may allow the process to be automated because of the increased space between the lamp and the fill holes. Further, the present apparatus and method describe the routing of leads coupling electrodes of the lamp to source connections coupled to the base member. Several exemplary embodiments of this routing are described.

In one exemplary embodiment, the lamp header also includes a channel formed in the lamp header for guiding a lead which is routed from the bottom end of the lamp out of the lamp engaging member, and to a location where it may be readily coupled to source connections on the base member.

In the following description, for purposes of explanation, numerous specific details are set forth in order to provide a thorough understanding of the present method and apparatus. It will be apparent, however, to one skilled in the art that the present method and apparatus may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1A:
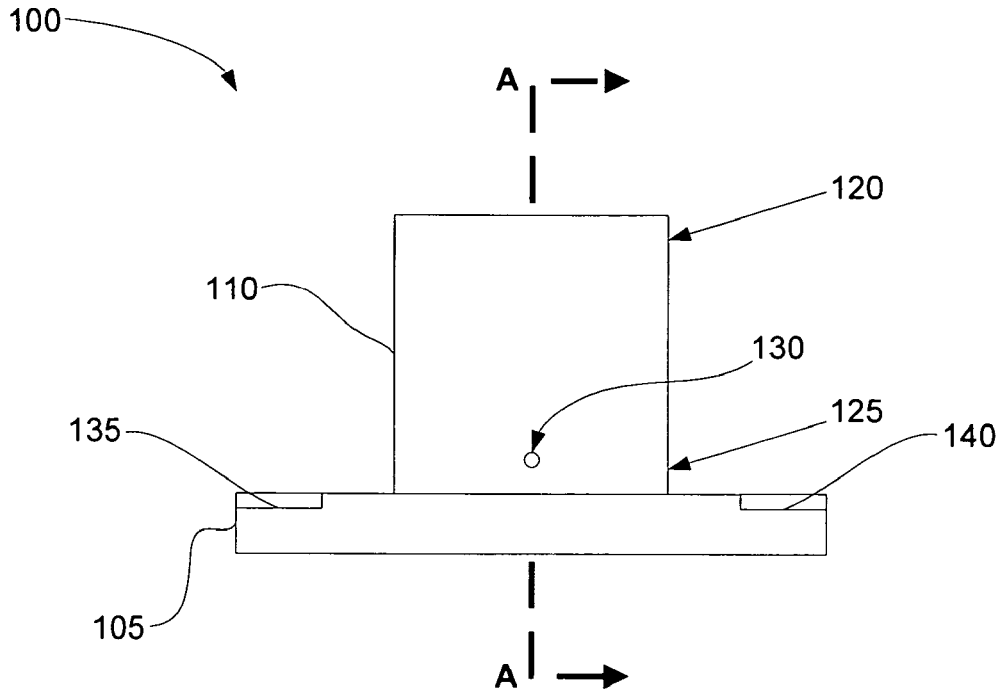
FIG. 1A illustrates a side view of a lamp header according to one exemplary embodiment.
Figure 1B:
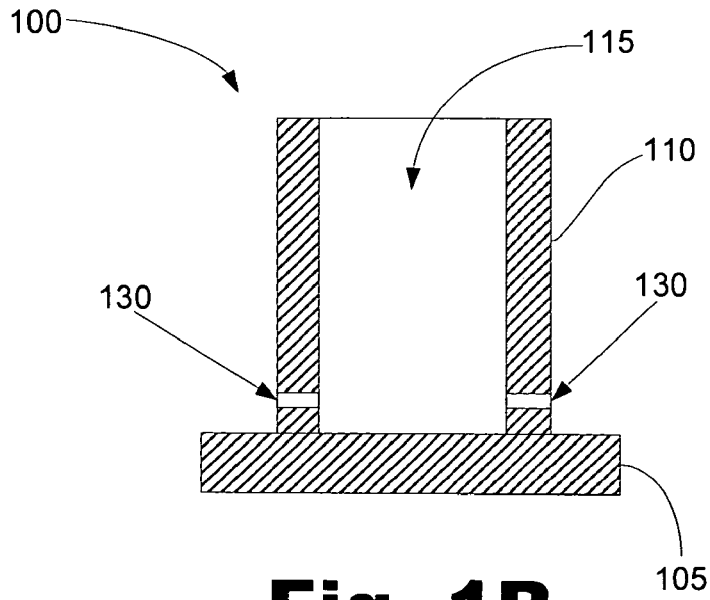
FIG. 1B illustrates a cross sectional view of the lamp header of FIG. 1A taken with respect to section A—A.

FIGS. 1A–B illustrate a lamp header (100) that generally includes a base member (105) and a lamp engaging member (110). The configuration of the lamp header (100) allows for a more rapid and more controlled application of an adhesive thereto. Further, this configuration allows a lamp to be removably coupled to a reflector assembly. As a result, the lamp and the header alone may be replaced without replacing a light generation assembly. FIG. 1A illustrates a perspective view of the lamp header and FIG. 1B illustrates a cross sectional view of the lamp header as taken from section A—A, in FIG. 1A.

The lamp engaging member (110) includes a lamp receiving cavity (115) defined in the lamp engaging member (110). The lamp receiving cavity (115) extends between a distal end (120) and a proximal end (125) of the lamp engaging member (110). Two fill holes (130) are defined in the proximal end (125) of the lamp engaging member (110), near the bottom of the lamp receiving cavity (115). The fill holes (130) provide access to the lamp receiving cavity (115) through the lamp engaging member (110). This access may be used by an adhesive applicator, such that adhesive may be introduced through the proximal end (125) of the lamp receiving cavity (115), rather than through the opening in the distal end. By applying adhesive from the proximal end (125) of the lamp engaging member (110), the adhesive is simultaneously forced upward and around the lamp, thereby maximizing coverage of the applied adhesive while minimizing voids between the lamp and the header. The base member (105) includes first source connections (135) and second source connections (140) formed on a front or first surface of the base member. The configuration of the electrical connections will be discussed in more detail below.

Exemplary Implementation and Operation

Figure 2:
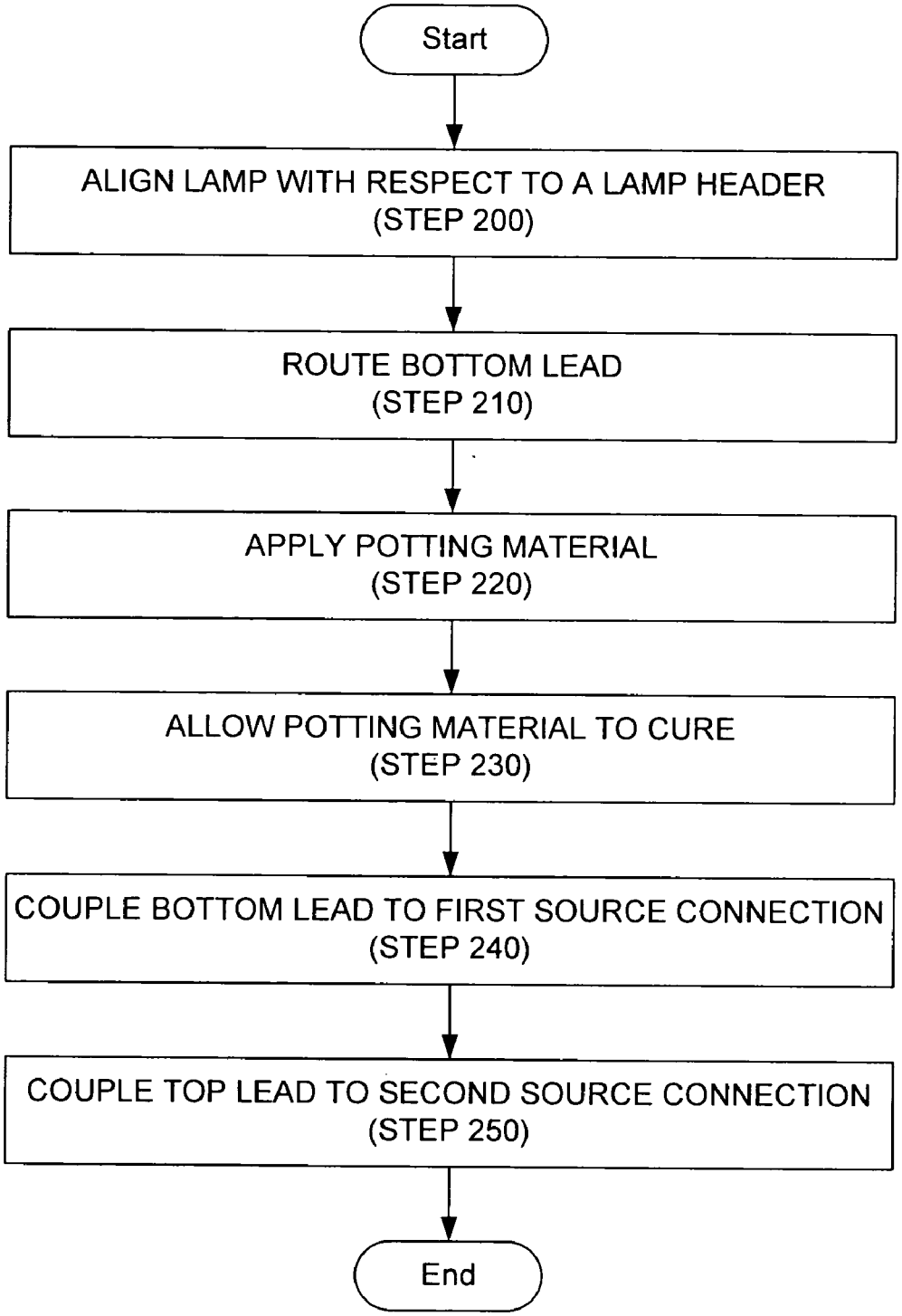
FIG. 2 is a flowchart illustrating a method of forming a lamp assembly according to one exemplary embodiment.

FIG. 2 is a flowchart illustrating a method of forming a lamp assembly. The assembly begins by aligning a lamp with respect to a lamp header (step 200). As discussed heretofore, correct alignment of the lamp with respect to each part of the system is necessary for optimal operation. Using automated alignment, which may include but is not limited to laser and optical alignment, the lamp is placed within the header and aligned relative to a 'standardized' reflector. More specifically, a portion of the lamp is placed at least partially within a lamp receiving cavity. The lamp may then be aligned such that when operating, a light emitting source, such as a fireball generator, is at the focal point of a reflector, such as by aligning the fireball generator with respect to a datum on the lamp header. The standardized reflector preferably represents a reflector of the type typically used with the lamp. Misalignment of the focal point causes degradation of the image since less light is captured and creates 'hot spots' on the screen instead of a uniform brightness.

Once the lamp has been aligned with respect to the lamp header (step 200), a first or bottom lead, which is coupled to a first or bottom electrode of the lamp, is routed out of the lamp receiving cavity (step 210). As will be discussed in more detail below, there are several ways to route the bottom lead out of the lamp receiving cavity. As discussed with reference to FIG. 4, the lead may be routed out of the lamp receiving cavity by way of a small hole in the bottom of the base member. Further, as discussed with reference to FIG. 5, the lead may be coupled to the lamp by retaining a tag end of the lead outside of the lamp receiving cavity and coupling the tag end to a first source connection. Further still, as discussed with reference to FIG. 6, the bottom electrode may be coupled to an electrical interconnect contained within the lamp header. The interconnect serves as a lead in that it provides a path between a source connection and the bottom electrode. Coupling the electrical interconnect to the bottom electrode (step 210) occurs simultaneously with alignment of the lamp with respect to the lamp header (step 200).

Once the bottom lead has been routed out of the lamp receiving cavity, a potting material, such as a ceramic adhesive is applied (step 220). The ceramic adhesive may be introduced through a proximal end of the lamp header material. Introduction of the ceramic adhesive to the proximal end lamp assembly allows for easier automation of the process while reducing voids of the applied adhesive between the lamp and lamp header.

After the potting material has been applied, the potting material is allowed to cure (step 230), thereby securing the lamp to the lamp header in the aligned relationship established above (step 200). Once the aligned relationship has been secured, the bottom lead is coupled to a first source connection (step 240). A second or top lead is then coupled to a second source connection (step 250). The above-mentioned method will now be explained in detail below with reference to FIG. 3 through FIG. 9.

Figure 3:
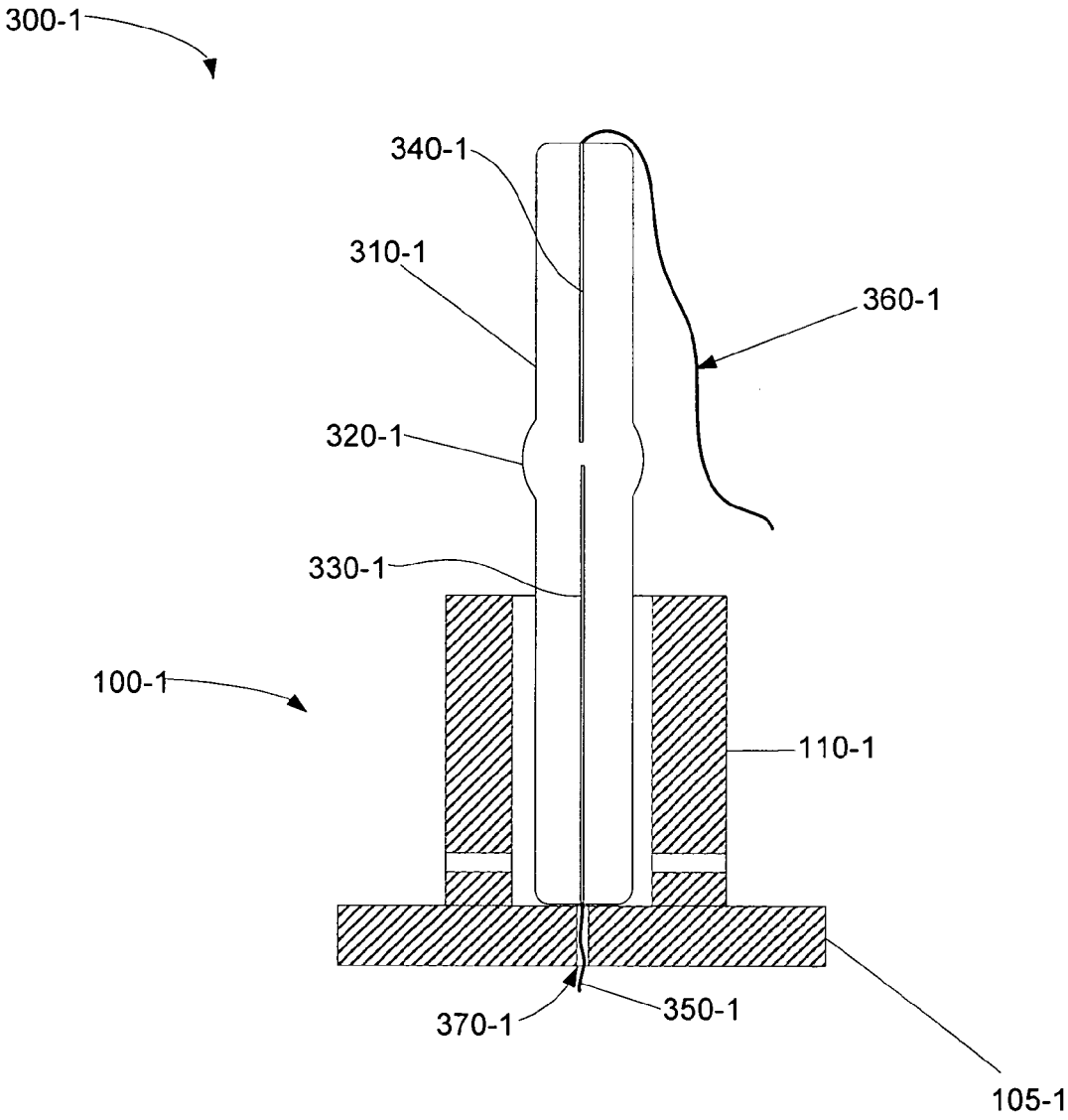
FIG. 3 is a lamp assembly in which a bottom electrode is routed through a bottom portion of a lamp header according to one exemplary embodiment.

FIG. 3 illustrates a lamp assembly (300-1) after an alignment operation (step 200; FIG. 2) and after a lead has been routed out (step 210; FIG. 2). The lamp assembly (300-1) includes a lamp (310-1) that has been placed within the lamp receiving cavity (115) of the lamp engaging member (110-1) and aligned with respect to the lamp header (100-1). The lamp (310-1) may be of any type that produces sufficient light for projection and/or television applications. An example of a lamp is an ultra-high pressure (UHP) arc lamp. For ease of reference, a UHP lamp will be described in the illustrated implementation. The lamp (310-1) creates a fireball in a central portion (320-1) of a mercury vapor or other vapor filled tube that results in the generation of a plasma caused by an arc across first and second electrodes (330-1, 340-1). The arc is created by a voltage difference or potential across the first and second electrodes (330-1, 340-1).

In the illustrated implementation, the first or bottom electrode (330-1) is coupled to a first or bottom lead (350-1). Similarly, the second or top electrode (340-1) is connected to a second or top lead (360-1). The bottom lead (350-1) is extended through a hole (370-1) defined in the base member (105-1). Once the lamp has been aligned with respect to the lamp header (step 200; FIG. 2) and the bottom lead (350-1) has been routed out of the lamp receiving cavity (115-1) (step 210), a potting material is applied (step 220).

Figure 4:
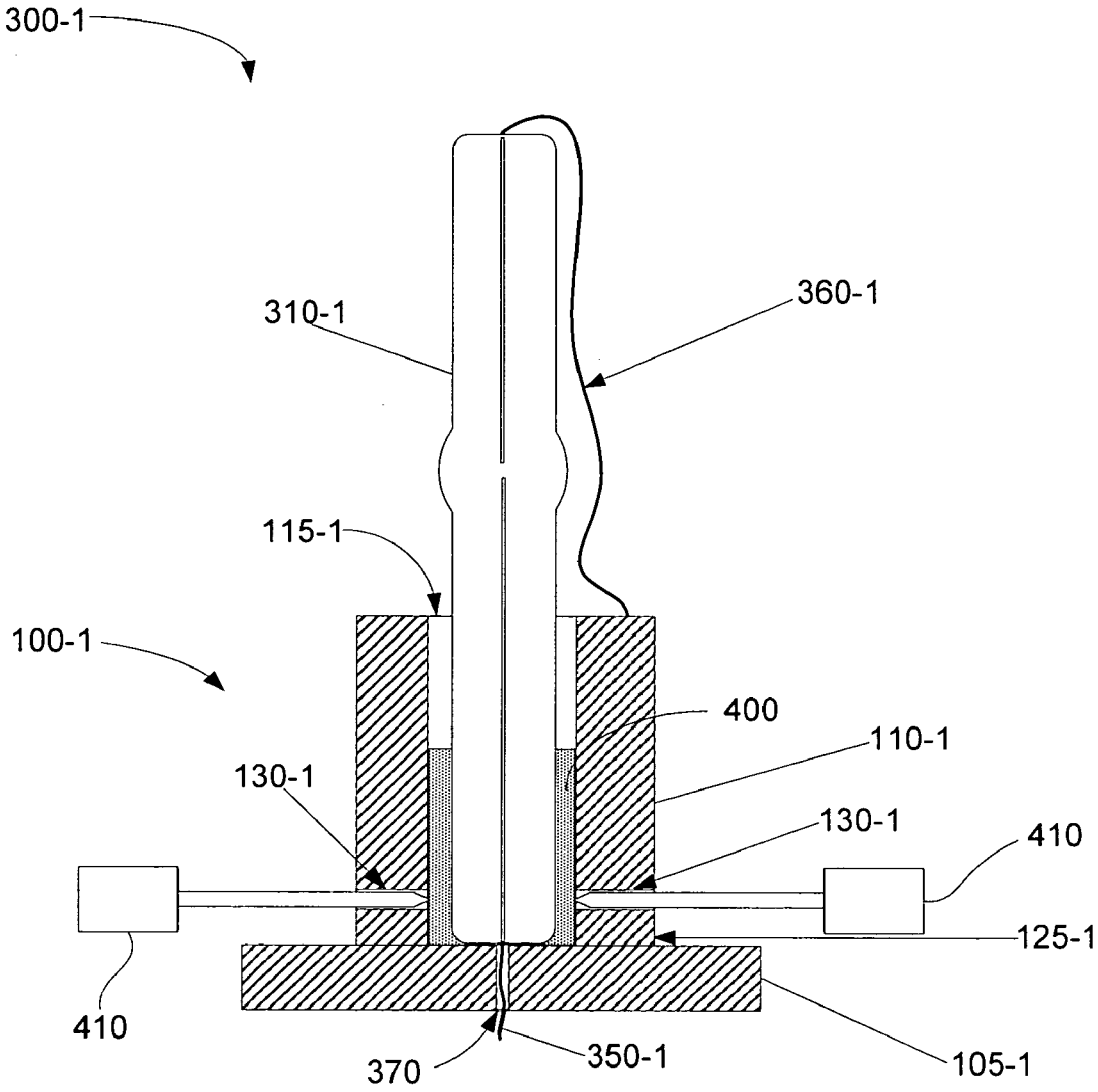
FIG. 4 illustrates the lamp assembly of FIG. 3 as a potting material is applied thereto according to one exemplary embodiment.

FIG. 4 illustrates the lamp assembly as a potting material is applied (step 220). The potting material or adhesive (400) is applied by adhesive applicators such as adhesive needles (410) that access the lamp receiving cavity (115-1) by way of the fill holes (130-1) in the proximal end (125-1). The potting material (400) may be any material suitable for securing and substantially fixing the relative position of the lamp (310-1) with respect to the lamp header (100-1). Examples of suitable potting materials include heat-resistant ceramic adhesives or epoxies.

The introduction of the adhesive (400) through the fill holes (130-1) in the proximal end (125-1) causes the potting material (400) to fill the gap between the lamp receiving cavity (115-1) and the lamp (310-1) from the bottom. In addition, the adhesive may be applied to opposing sides of the lamp (310-1). The pressure of the entering potting material (400) causes the potting material to flow around the lamp. As the bottom of the lamp is filled, application of the potting material (400) continues at a pressure sufficient to cause the potting material to fill the gap from the bottom upward. As the level of the potting material rises, voids between the lamp (310-1) and the lamp engaging member (110-1) are minimized because the potting material (400) is pushed up the gap from the bottom filling substantially the entire gap as the level of the potting material (400) rises.

Once the lamp (310-1) has been secured to the lamp header (100-1), the bottom lead (350-1) is coupled to source connections formed on the lamp header, as described above (step 240; FIG. 2). In addition, the top lead (360-1) extends from the distal end of the lamp (310-1) to the lamp header (100-1) where it is coupled to a second electrical source which is also part of the lamp header (100-1). As shown in FIG. 4, the source connection is coupled to the first source connection by way of a first electrical interconnect, which extends from a second lamp connection formed on a lip portion of the lamp header, through the lamp header (100-1), and to the first source connection.

Figure 5:
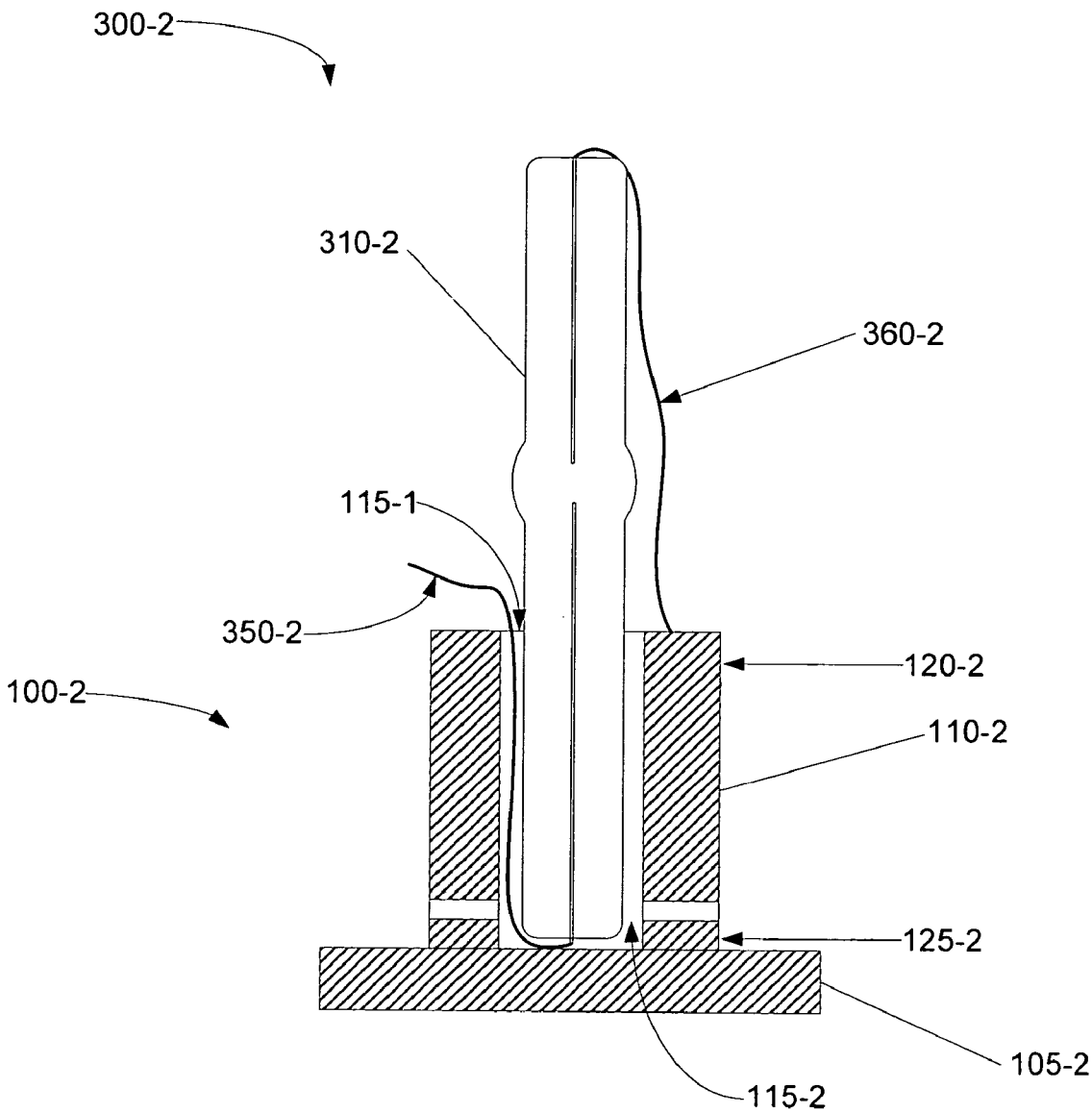
FIG. 5 is a lamp assembly in which a bottom electrode is routed through the top of a lamp engaging member according to one exemplary embodiment.

As shown in FIG. 5, the bottom lead (350-2) may also be coupled to a lamp (310-2) and routed out of the distal end (120-2) of the lamp receiving cavity (115-2). In such an implementation, a portion of the lamp (310-2) is inserted into the lamp receiving cavity (115-2), while a portion of the bottom lead (350-2), such as the tag end, is retained outside of lamp receiving cavity (115-2). As a result, the bottom lead (350-2) is routed out of the lamp receiving cavity (step 210; FIG. 2) during an initial stage.

The lamp (310-2) is then aligned with respect to the lamp header (100-2), as described above (step 200; FIG. 2). After the lamp (310-2) has been aligned, the potting material is applied and cured (steps 220, 230; FIG. 2) as described with reference to FIG. 4. Once the potting material has cured, the bottom lead (350-2) may be coupled to the first source connection (step 240) and the top lead (360-2) may be coupled to the second source connection (step 250). Exemplary configurations of source connections will be discussed in more detail with reference to FIGS. 7A–7B and FIGS. 8A–8B.

Figure 6:
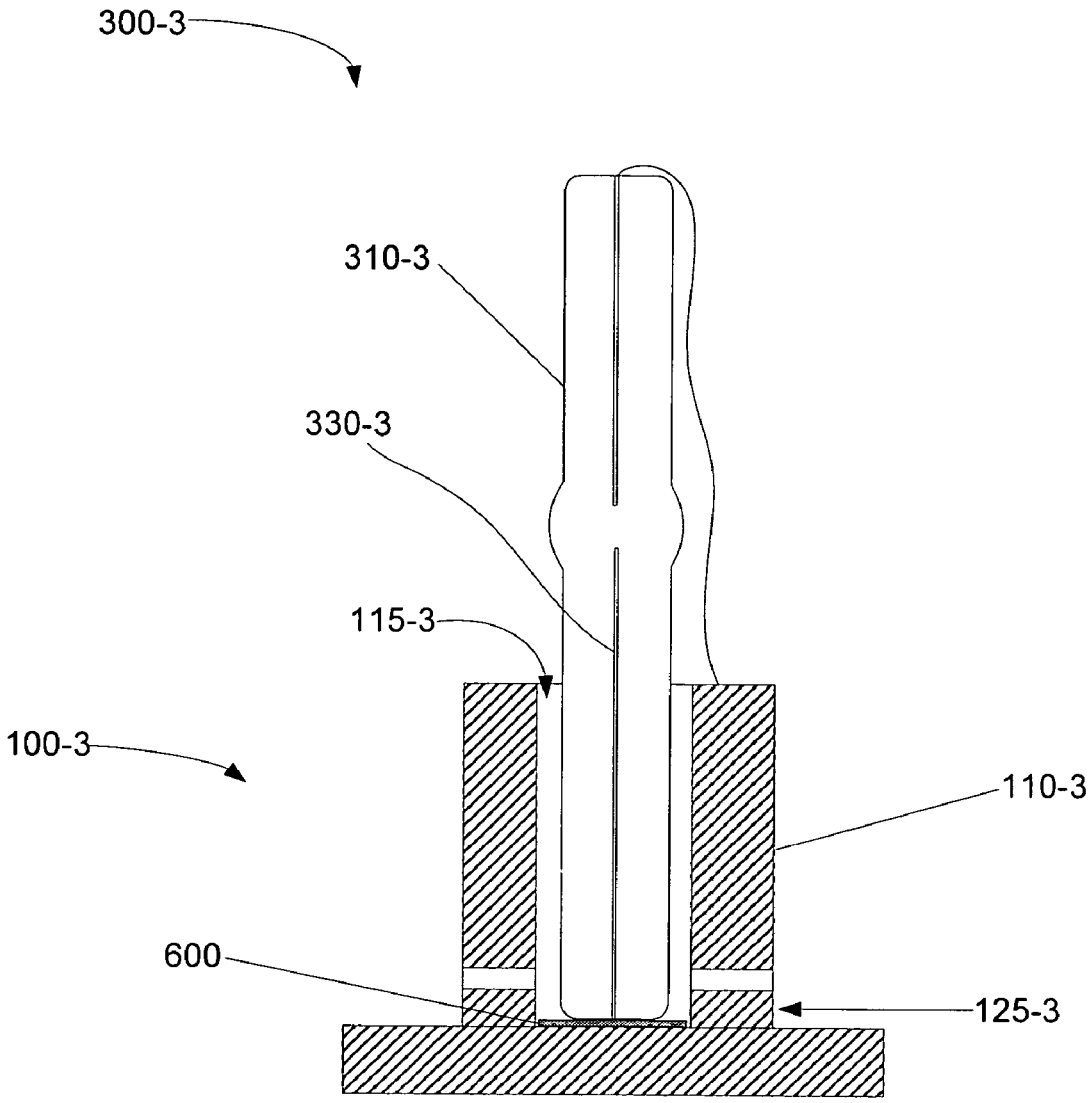
FIG. 6 is a lamp assembly in which a bottom electrode is coupled to a lead formed in the bottom of a lamp receiving cavity according to one exemplary embodiment.

FIG. 6 illustrates a lamp assembly (300-3) in which a bottom lamp connection (600) is formed in a bottom portion of the lamp receiving cavity (115-3), near the proximal end (125-3) of the lamp engaging member (110-3). In the formation of the lamp assembly (300-3), the bottom electrode (330-3) is coupled to the bottom lamp connection (600) during substantially the same operation in which the lamp (310-3) is aligned with respect to the lamp header (100-3). The bottom lamp connection (600) is in turn coupled to a first interconnect and a first source connection. Accordingly, placing a portion of the lamp (310-3) in the lamp receiving cavity (115-3) allows for the substantially simultaneous alignment of the lamp header (step 200; FIG. 2) and coupling of the bottom lead to the first source connection (step 240; FIG. 2).

Further, as will be discussed in more detail below, the bottom lamp connection (600) couples the bottom electrode (330-3) to the first source connection. As a result, the bottom interconnect may serve as a bottom lead (350-1, 350-2; FIGS. 4–5). Consequently, placing a portion of the lamp (310-3) in the lamp receiving cavity (115-3) may also allow for substantially the same result as simultaneously routing the bottom lead from the lamp receiving cavity (step 210; FIG. 2).

Figure 7A:
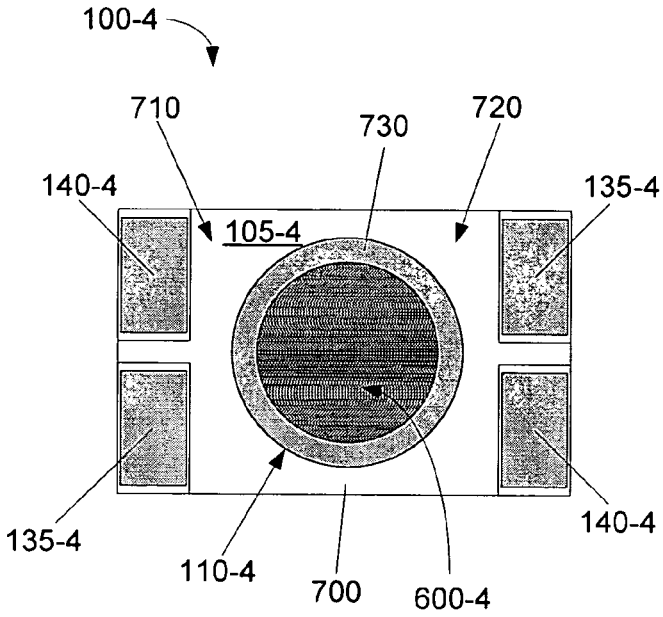
FIG. 7A illustrates a top view of a lamp header according to one exemplary embodiment.

FIG. 7A illustrates the electrical circuitry of an exemplary lamp header (1004). The base member (105-4) includes first source connections (135-4) and second source connections (140-4) formed on a front or first surface (700) of the base member (105-4). The first source connections (135-4) are located in opposing corners of first and second lateral portions (710, 720) of the front surface (700). The second source connections (140-4) are located in the other opposing corners of the first and second lateral portions (710, 720). As a result, each of the lateral portions (710, 720) has a first source connection (135-4) and a second source connection (140-4). The source connections may be of opposite polarity, such that one is a positive source connection and the other is a negative source connection.

Electrical interconnects are formed within the header and electrically couple the source connections (135-4,140-4) on one lateral portion to the electrical source connections on the other lateral portion. The electrical interconnects may be configured to couple the electrodes (330-4, 340-4) of a lamp (310-4) to source connections (135-4, 140-4).

The lamp header (100-4) may formed as a multi-layered ceramic (MLC) part having multiple layers of green sheets. Green sheets are sheets that include a solidified slurry of organic and ceramic materials. The sheets may range in thickness depending on design but usually are from 0.005 to 0.05 inches thick having electrical circuitry patterned thereon. By using a MLC design, the required power connections can be provided and heat stability can be attained. A MLC can provide electronic power and signal routing in a manner that is similar to the function of a PC board. By building up the header in layers, traces and vias can be created on each side of the individual layers of green sheets. After processing, the traces and vias may be coupled to form electrical interconnects that are contained substantially within the lamp header.

The layers of green sheets with electrical circuitry patterned thereon are aligned to insure proper alignment of the electrical circuitry of each of the green sheets. The green sheets are then cut and fired. The firing process removes the organic binder by burning it from the solidified slurry thereby leaving a homogenous ceramic device. As a result, the green sheets are fused together creating a solid ceramic header (100-4) that has electrical connections throughout its interior. For example, the layers are made mainly of aluminum oxide and the electrical circuitry is made of tungsten. These layers allow the header to withstand the heat generated by the lamp during operation.

Figure 7B:
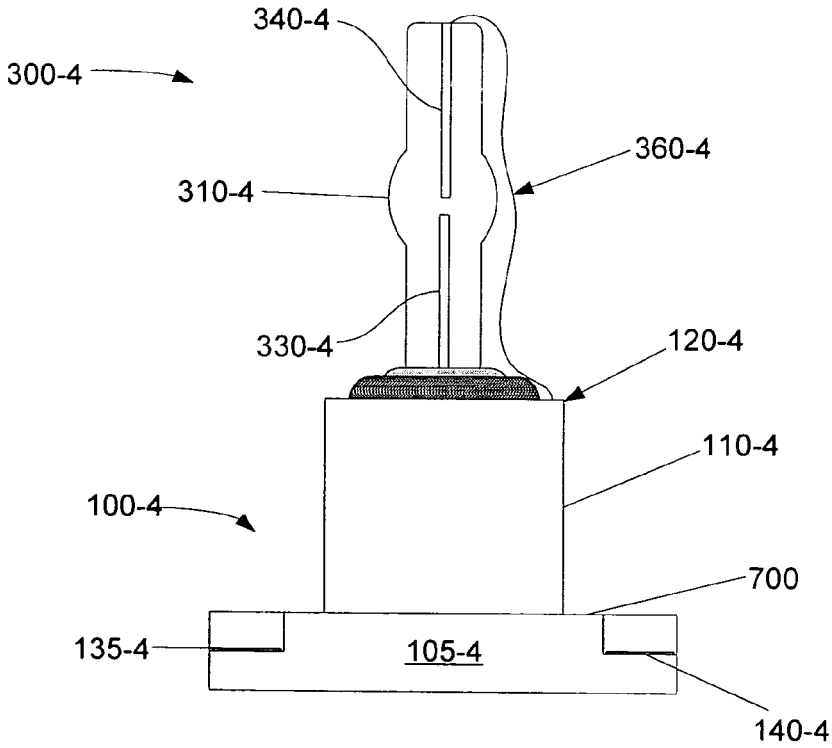
FIG. 7B illustrates a lamp assembly according to one exemplary embodiment.

The lamp assembly (300-4) shown in FIGS. 7A–7B, a top lamp connection (730) is formed on the distal end (120-4) of the lamp engaging member (110). The top lamp connection is in turn coupled to a top electrical interconnect, which is within the lamp header (100-4). The top electrical interconnect is configured to allow the top electrode (3404) to be coupled to each of the second source connections (140-4). For example, the top electrical interconnect may be contained substantially within the lamp header (100-4) such that coupling the top lead (360-4) to the top electrical interconnect (730) near the distal end (120-4) of the lamp engaging member (110-4) establishes an electrical connection between the top electrode (340-4) and the second source connection (140-4) by way of the top electrical interconnect.

The lamp header (100-4) also includes a bottom electrical interconnect formed therein. The bottom interconnect is configured to allow the bottom electrode (330-4) to be coupled to each of the first source connections (135-4). The bottom electrical interconnect is contained substantially within the lamp header such that the bottom electrode (330)

may be directly coupled to the bottom lamp connection (600-4) to establish an electrical connection between the bottom electrode (330-4) and the first source connection (135-4) through the bottom interconnect.

Figure 8A:
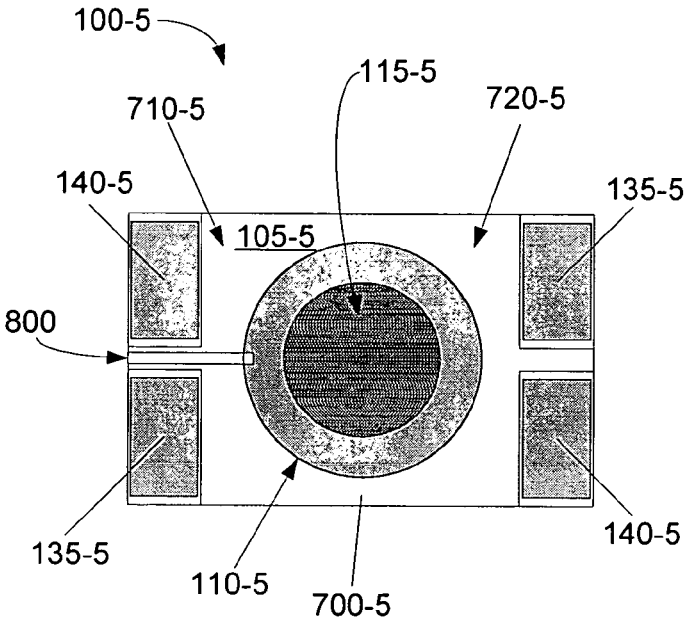
FIG. 8A illustrates a top view of a lamp header according to one exemplary embodiment.
Figure 8B:
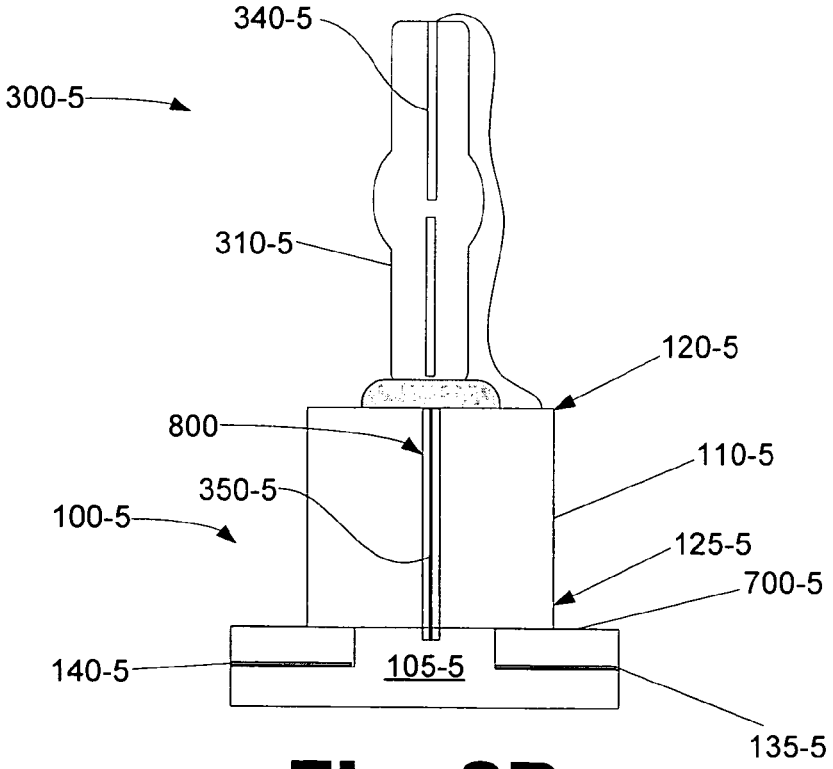
FIG. 8B illustrates a lamp assembly according to one exemplary embodiment

In other implementations, as shown in FIGS. 8A–8B a channel (800) is defined in the lamp header (100-5). The channel (800) is configured to provide a path for the bottom lead (350-5) between the distal end (120-5) of the lamp engaging member (110-5) and the first source connection (135-5) on the first lateral portion (710-5). The channel (800) extends from the distal end (120-5) to the proximal end (125-5) of the lamp engaging member (110-5) and across the front surface (700-5) of the base member (105-5). The channel (800) is also sized to allow a lead to be placed substantially therein.

The path provided by the channel (800) may allow for more rapid location of the lamp (310-5) with respect to the lamp receiving cavity (115-5). For example, the tag end of the bottom lead (350-5) may be retained outside of the lamp receiving cavity during a lamp placement or location operation. As a result, the bottom lead (350-5) may then be placed within the channel (800) and coupled to the first source connection (135-5) without having to separately route the bottom lead (350-5) out of the lamp receiving cavity (115-5). Further, since routing of the lead out of the lamp engaging member (110-5) may be substantially accomplished by retaining the tag end outside of the lamp receiving cavity (115-5), the precision required to route the bottom lead (350-5) from the lamp receiving cavity (115-5) may be reduced, thereby increasing the speed with which the placement operation may be performed.

Once the lamp (310-5) has been aligned with respect to the lamp header (100-5), the potting material (400; FIG. 4) is applied and allowed to cure, as described above (steps 220, 230; FIG. 2). The bottom lead (350-5) may then be placed within the channel (800) and then coupled to the first source connections (135-5) by soldering or other appropriate methods. Further, electrical interconnects may be formed in the channel (800) that couple the channel to the first source connections (135-5). By using the channel (800) to guide the bottom lead (350), the lamp connections may be quickly and reliably established, thereby reducing the time required to form the lamp assembly. Further, by guiding the bottom lead (350-5) through the channel, the first surface (700-5) remains substantially planar, so that the lamp assembly (300-5) may be mounted flush with respect to a reflector assembly, as will be discussed in more detail below.

Figure 9:
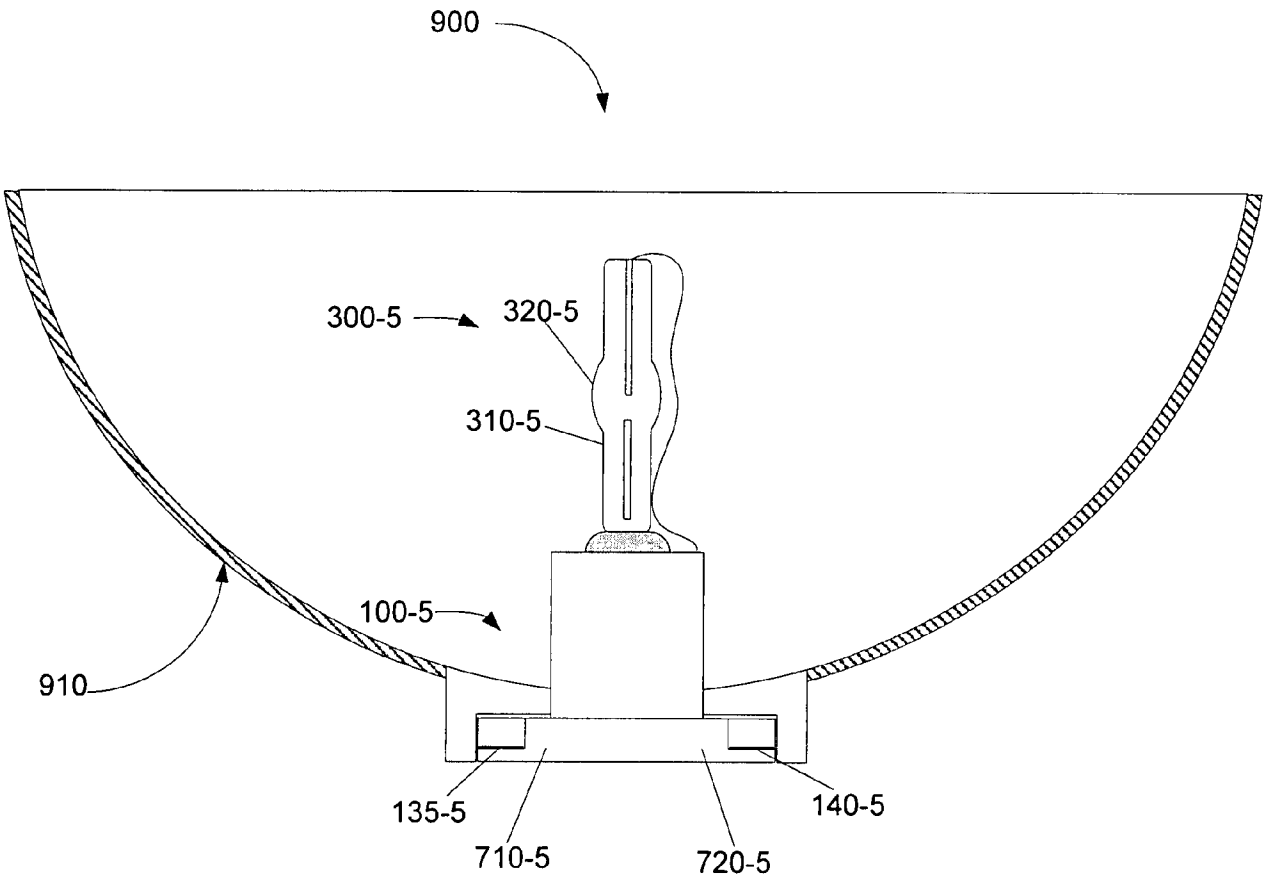
FIG. 9 illustrates a light generation assembly according to one exemplary embodiment.

FIG. 9 illustrates a light generation assembly (900). The light generation assembly (900) includes a reflector assembly (910) and a lamp assembly (300-5). The reflector assembly (910) may of any suitable type, including hyperbolic shapes such as parabolic or elliptical. In addition to increasing the speed and control of adhesive application, the lamp header (100-5) is also configured to be rotated 180 degrees with respect to a reflector assembly. The lamp (310-5) is aligned with respect to a reflector assembly (910) such that the central portion (320-5), where the fireball is generated, is placed in an optimal position within the reflector assembly (910). In some embodiments, the optimal position of the fireball is the focal point of the reflector assembly (910) during operation of the lamp. Other embodiments have the position slightly offset to account for heating or gravitational effects during operation.

The present apparatus also provides for the maintenance of this optimal position, regardless of the mounting configuration of the reflector assembly (910). One example of a mounting configuration for the projector system is on a table. In this configuration, the reflector assembly (910) is in a first orientation. As previously discussed, the heat generated by the lamp (310-5) is extreme. As a result of the heat created by the fireball, the fireball tends to elevate slightly in the vertical direction. This elevation is taken into account during alignment and, as a result, when the fireball elevates due to the heat, it elevates to its optimal position with respect to the reflector assembly (910). However, when the projector system is inverted, as would be the case if the projector system is mounted to an overhead support such as a ceiling, the reflector assembly (910) is inverted from the first orientation to a second orientation. As a result, in order to maintain the fireball in the optimal position with respect to the reflector assembly (910) after the fireball elevates as a result of heating, it would be necessary to rotate the lamp assembly 180 degrees with respect to the reflector assembly (910) to a second orientation. Such rotation is possible because the source connections (135-5, 140-5) are disposed on both the first and second lateral portions (710-5, 720-5). As a result, the lamp assembly may be rotated 180 degrees with respect to the reflector assembly while maintaining the electrical connections.

Once the lamp has outlived its useful life, the lamp assembly may be replaced. The ability to replace the lamp assembly without replacing the reflector assembly significantly lowers the cost of ownership of the projector system. Lower operating costs may in turn increase the sales of projector systems into consumer environments.

In conclusion, the disclosure provides for the application of adhesive through the proximal end of a lamp header. This configuration allows for more rapid and more controlled application of the adhesive. In addition, the present disclosure provides for various routing configurations of electrical connections between the lamp and source connections. Further, the lamp header may be separately replaced, thereby reducing the costs of operating a light generation assembly.

The preceding description has been presented only to illustrate and describe the present method and apparatus. It is not intended to be exhaustive or to limit the disclosure to any precise form disclosed. Many modifications and variations are possible in light of the above teaching. It is intended that the scope of the invention be defined by the following claims.

What is claimed is:

1. A method of forming a lamp assembly, comprising:

providing a lamp header having a base member and a lamp engaging member extending from a first surface of said base member wherein said lamp engaging member includes a lamp-receiving cavity having an opening for receiving a lamp and at least one fill hole, separate from said opening, that communicates from an exterior of said lamp engaging member with said cavity;

aligning a lamp with respect to said lamp header, an portion of said lamp being placed through said opening and into said lamp-receiving cavity; and applying an adhesive through said fill hole.

2. The method of claim 1, and further comprising allowing said adhesive to cure to secure said lamp in an aligned relationship with respect to said lamp header.

3. The method of claim 1, and further comprising coupling a bottom lead of said lamp to at least one first source connection coupled to said base member.

4. The method of claim 3, wherein coupling said bottom lead of said lamp source to said first source connection comprises routing said lead out of a distal end of said lamp engaging member through a channel defined in said lamp header.

5. The method of claim 3, and further comprising coupling a top lead of said lamp to at least one second source connection coupled to said base member.

6. The method of claim 5, further comprising coupling said top lead to a connection formed on a lip of said lamp-engaging cavity, said connection extending through and internal to said lamp-engaging member to said at least one second source connection of said base member.

7. The method of claim 1, wherein said adhesive comprises a ceramic adhesive.

8. The method of claim 1, wherein said adhesive comprises an epoxy.

9. The method of claim 1, wherein said lamp engaging member comprises at least two fill holes, said applying an adhesive further comprising applying adhesive through said at least two fill holes to at least two corresponding different locations inside said cavity.

10. The method of claim 9, wherein said two fill holes are disposed on opposite sides of said portion of said lamp in said cavity.

11. The method of claim 1, wherein applying said adhesive through said fill hole further comprises applying said adhesive under pressure to cause said adhesive to flow around said portion of said lamp in said cavity.

12. The method of claim 1, wherein applying said adhesive through said fill hole further comprises applying said adhesive under pressure sufficient to cause said adhesive to flow upward toward said opening of said lamp-receiving cavity.

13. The method of claim 1, wherein applying said adhesive through said fill hole further comprises applying said adhesive so as to substantially fill an entire gap between sides of said cavity and said portion of said lamp in said cavity.

14. The method of claim 8 further comprising:

forming electrical interconnections within layers of material used to form said lamp header; and electrically connecting leads of said lamp to said interconnections.

15. A lamp assembly, comprising:

a lamp header having a base member and a lamp engaging member extending from a first surface of said base member wherein said lamp engaging member includes a lamp-receiving cavity having an opening for receiving a lamp and at least one fill hole, separate from said opening, that communicates from an exterior of said lamp engaging member with said cavity; and a lamp configured for alignment with respect to said lamp header in which a portion of said lamp is placed through said opening and into said lamp-receiving cavity;

wherein said at least one fill hole is configured to receive an adhesive and admit said adhesive into said cavity between sides of said cavity and said lamp in said lamp-receiving cavity.

* * * * *